United States Patent [19]

Date et al.

[11] 4,220,471

[45] Sep. 2, 1980

[54] PHOTOGRAPHIC POLYPROPYLENE COATED PAPER SUPPORT WITH CORONA DISCHARGE TREATMENT AND POLYMERIC SUBBING LAYER

[75] Inventors: Sukeaki Date; Seigo Ebato, both of Nagaokakyo, Japan

[73] Assignee: Mitsubishi Paper Mills, Ltd., Tokyo, Japan

[21] Appl. No.: 948,644

[22] Filed: Oct. 4, 1978

[30] Foreign Application Priority Data

Oct. 13, 1977 [JP] Japan ..... 52-122730

[51] Int. Cl.[2] ..... G03C 1/87

[52] U.S. Cl. ..... 430/532; 430/937; 430/538

[58] Field of Search ..... 96/85, 87 R, 75

[56] References Cited

U.S. PATENT DOCUMENTS

| | | | |
|---|---|---|---|
| 3,582,338 | 6/1971 | Yost et al. | 96/87 R |
| 3,607,345 | 9/1971 | Thomas et al. | 96/85 |
| 3,676,189 | 7/1972 | Woodward et al. | 96/85 |
| 3,711,284 | 1/1973 | Van Paasschen et al. | 96/87 R |
| 3,712,812 | 1/1973 | Van Paasschen et al. | 96/87 R |
| 3,793,029 | 2/1974 | Parkev | 96/85 |
| 3,874,880 | 4/1975 | Venor et al. | 96/87 R |
| 3,888,679 | 6/1975 | Komatsu et al. | 96/87 R |
| 4,135,932 | 1/1979 | Mann | 96/85 |

FOREIGN PATENT DOCUMENTS 99022 9/1974 Japan .

*Primary Examiner*—Charles L. Bowers, Jr.
*Attorney, Agent, or Firm*—Cushman, Darby & Cushman

[57] ABSTRACT

A photographic material comprising a support having on the surface a polypropylene resin component and a hydrophilic colloidal layer on the top surface which are firmly adhered together, is produced by subjecting the support having on the surface a polypropylene resin component to corona discharge, applying thereto a subbing layer comprising (a) at least one water-dispersed polymer latex selected from butadiene-acrylic ester copolymers, polyvinyl chloride and polystyrene, (b) a compound having an ethyleneimino group such as that capable of hardening a colloidal gelatin or casein, and (c) a water-soluble polymer, and providing a hydrophilic protective colloidal layer on said subbing layer.

8 Claims, No Drawings

PHOTOGRAPHIC POLYPROPYLENE COATED PAPER SUPPORT WITH CORONA DISCHARGE TREATMENT AND POLYMERIC SUBBING LAYER

This invention relates to a photographic material and, more particularly, to a photographic material comprising a support having on the surface a polypropylene resin component applied with a subbing layer capable of improving the strength of the adhesion between an emulsion layer and the support.

A recent trend in the field of silver halide photographic elements has been the increasing use of support materials having a hydrophobic surface such as polyethylene terephthalate, cellulose triacetate, polystyrene and polycarbonate, not to speak of polyethylene laminate paper with a synthetic resin layer containing polyethylene as major component on both sides of base paper. However, because of the hydrophobic surface of the support, it is very difficult to secure a strong adhesion between the support comprising such polymeric compounds and the photographic layers comprising a hydrophilic protective colloid such as gelatin (e.g., silver halide emulsion layer, antihalation layer, and the like).

Accordingly, various attempts have heretofore been made to improve the above disadvantage. Examples of such attempts include surface activativation treatments by means of chemicals, corona discharge, flame, high frequency electric field and laser beam; and a subbing system using a double-layer stratum with the first layer adhering firmly to a hydrophobic support and the hydrophilic second layer applied over the first layer; or a single-layer stratum in which the hydrophobic groups and the hydrophilic groups are balanced. Japanese patent application laid-open ("Kokai") No. 99,022/74 which corresponds to U.S. Pat. No. 3,888,679 has disclosed a method in which a compound having an ethyleneimino group and a water-dispersible polymeric substance (e.g., ethyl acrylate polymer) are incorporated in a photographic layer to secure direct adhesion between the photographic layer and the hydrophobic support.

Among the conventional methods of surface treatment for facilitating the adhesion of a polyolefin support to a hydrophilic photographic layer, one of the most popular is that by corona discharge (e.g., Japanese Patent Publication No. 9,411/56). However, the present inventors confirmed that among polyolefins polypropylene differs markedly from polyethylene in the behavior toward corona discharge. When subjected to the corona discharge treatment, polyethylene becomes sufficiently improved in adherence, whereas polypropylene is improved only slightly in adhesion strength and requires a suitable aftertreatment.

Other surface activation treatments mentioned above have also various defects such as, for example, (1) insufficient adhesion strengths in the dry and met states, (2) the use of solvents or substances harmful to the human body or liable to give rise to public hazard, (3) generation of noxious gases, and (4) complicated treatment procedure not suitable for mass production.

The present inventors have succeeded in eliminating the aforementioned difficulties of the conventional methods.

An object of this invention is to provide a photographic material having a subbing layer capable of firmly adhering to both the support with polypropylene surface and the photographic layer comprising a hydrophilic protective colloid.

Another object of this invention is to provide a photographic material in which the support and the photographic layer are adhered together through a water-soluble subbing composition requiring not necessarily a noxious organic solvent which may cause public hazard.

Other objects and advantages of this invention will become apparent from the following description.

The above objects are achieved, according to this invention, by subjecting a support having on the surface a polypropylene resin component or corona discharge treatment, applying to the pretreated support a subbing layer comprising of (a) at least one water-dispersed polymer latex selected from butadiene-acrylic ester copolymers, polyvinyl chloride and polystyrene, (b) a compound having an ethyleneimino group, and (c) a water-soluble polymer compatible with said water-dispersed polymer latex, and then providing a photographic layer comprising a hydrophilic colloid on said subbing layer.

This invention is based on the idea that the excellent adhesion strengths in both dry and wet state may be obtained by using a subbing layer in which the hydrophobic groups and the hydrophilic groups are present in harmonized proportions. The functions of the subbing composition of this invention may roughly resolved into augmentation of the dry adhesion strength due chiefly to the components (a) (butadiene-acrylic ester copolymer, polyvinyl chloride or polystyrene and (b) (compound having an ethyleneimino group) and enhancement of the wet adhesion strength due chiefly to the component (c) (water-soluble polymer).

When these components are used in the subbing layer of this invention, the void between the adjacent particles of the water-dispersed polymer latex (hereinafter referred sametimes to as spherical pigment) is filled with other components (b) and (c), resulting in a mosaic arrangement of hydrophilic groups and hydrophobic groups of the components (a), (b) and (c). Such an arrangement of the groups contributes to the formation of firm adhesion between the hydrophobic polypropylene base and the photographic layer comprising a hydrophilic colloid. In addition, because of being fine particles of approximately the same size, the spherical pigment has another advantage of effectively diffusing the light ray, resulting in improvement of the whiteness.

Those butadiene-acrylic ester copolymers (for example, butadiene-methyl methacrylate, butadiene-ethyl methacrylate, butadiene-n-propyl methacrylate, butadiene-methyl acrylate, butadiene-hexyl acrylate, butadiene-n-butyl methacrylate, butadiene-octyl methacrylate, butadiene-octyl acrylate and butadiene-dodecyl acrylate), vinyl chloride homopolymer, and styrene homopolymer which are easily available commercially as emulsion polymerization products. Examples include butadiene-acrylic ester copolymer types such as Crosren 2M-30, 2M-33, 2M-33A, 2M-36 and 2M-38 (Takeda Chemical Co.), Polylac ML-508, ML-520, ML-501, ML-505, ML-577 and ML-264 (Mitsui Toatsu Chemical Co.), and Copolex #1001 and #1031 (Japan Gas-Chemical Co.); polyvinyl chlorid types such as Geon 151, 576 and 351 (Japanese Geon Co.); and polystyrene types such as Plastic Pigment D.P.P. 722 (Dow Chemical Co.) and Plastic Pigment Lytron 2128 and 1259 (Monsanto Chemical Co.). All of these commercial products can be used satisfactorily.

The compounds having ethyleneimino groups suitable for the component (b) are known for the most part as hardeners for colloids such as gelatin and casein in the photographic industry [Mees: "The Theory of the photographic Process.," (b 1966) p. 58 ]. Typical examples of known compounds are:

| Compound No. | |
|---|---|
| 1 | 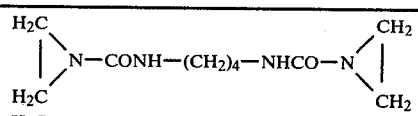 |
| 2 | 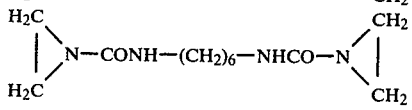 |
| 3 | 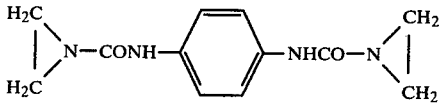 |
| 4 | 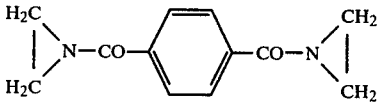 |
| 5 | 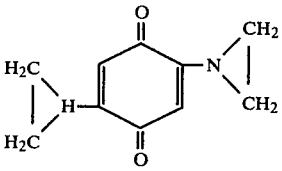 |
| 6 | 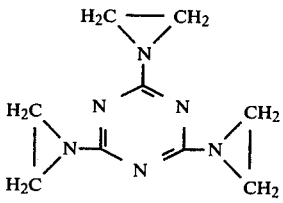 |
| 7 | 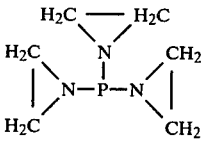 |
| 8 | 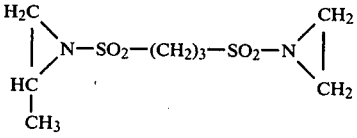 |
| 9 | 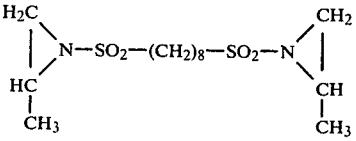 |
| 10 | 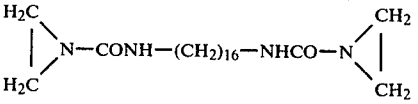 |
| 11 | 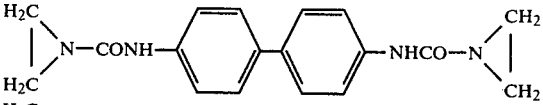 |
| 12 | 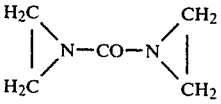 |
| 13 | 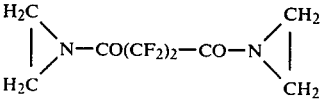 |

-continued
| Compound No. | |
|---|---|
| 14 | 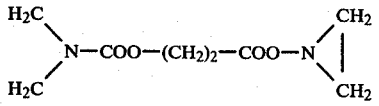 |
| 15 | 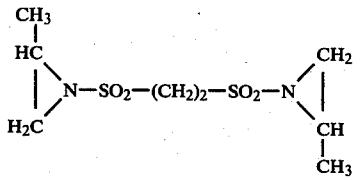 |
| 16 | 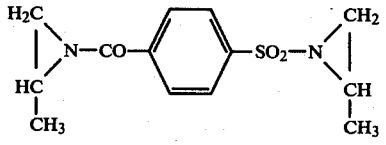 |
| 17 | 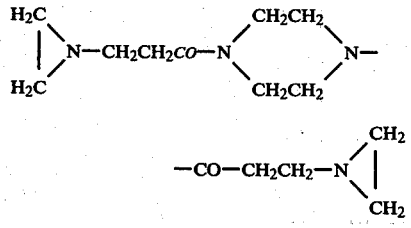 |
| 18 | 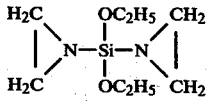 |
| 19 | 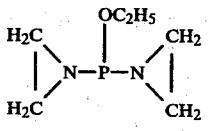 |
| 20 | 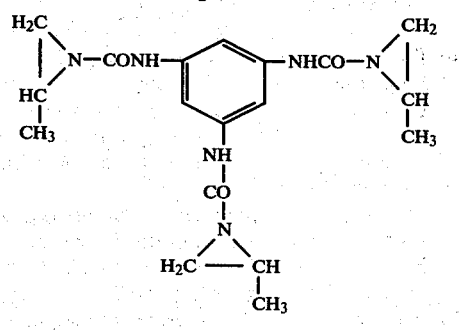 |
| 21 | 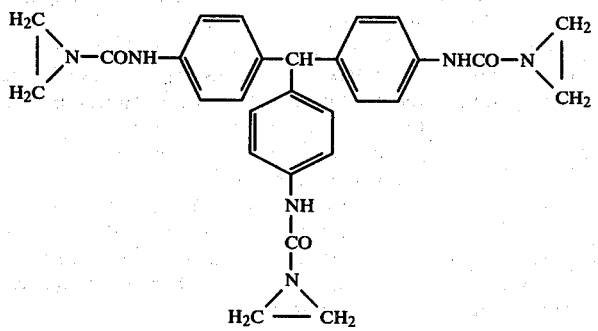 |
| 22 | 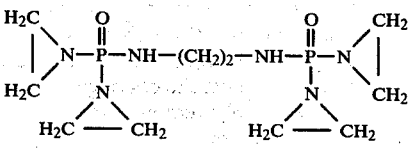 |

-continued

| Compound No. | |
|---|---|
| 23 | 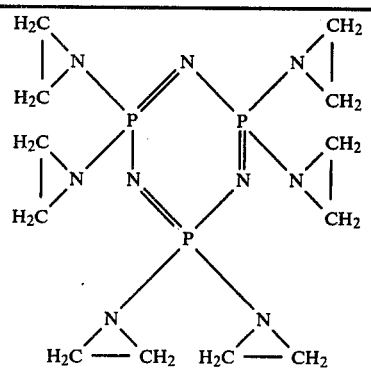 |
| 24 | Polyethyleneimine |
| 24 | 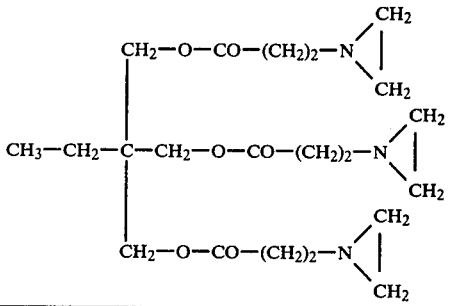 |

The water-soluble polymers suitable for the component (c), which must be compatible with the component (a), include many of the known water-soluble polymers. Typical examples are proteins and derivatives thereof such as casein, gelatin and grafted gelatin; cellulose derivatives such as carboxymethylcellulose (CMC) and hydroxyethylcellulose (HEC); polysaccharides and hydrolyzates thereof such as starch and dextrin; vegetable gums; and synthetic polymers such as polyvinyl alcohol, polyacrylamide, polyvinylpyrrolidone, styrene-maleic acid copolymer and ethylene-maleic acid copolymer.

The coating composition for the subbing layer of this invention contains, in terms of solids, component (a): about 0.1 to about 20%, preferably about 0.5 to about 10%, component (b): about 0.05 to about 10%, preferably about 0.1 to about 5%, and component (c): about 0.05 to about 10%, preferably about 0.1 to about 5% . The coating weight of the subbing composition is about 0.01 to about 20 $g/m^2$, preferably 0.05 to 5 $g/m^2$ in terms of solids. The mixing ratio of the components and the coating weight of the subbing composition do not limit the scope of this invention.

The subbing layer according to this invention exhibits improved adhesion to both the hydrophilic protective colloid layer and the support materials comprising polypropylene resin component at least in the outermost layer, such as so-called resin-coated paper in which a base paper is overlaid with thin polypropylene film or polyethylene film coating some polypropylene, and synthetic paper (e.g. "Yupo" of Oji Yuka Co.) comprising polypropylene as major component and incorporated with white pigments such as titanium white and talc, not to speak of polypropylene film. The corona discharge treatment of the polypropylene sheet prior to application of the subbing composition leads to distinguished enhancement of the adhesion strength of the subbing composition itself and, in its turn, to the improvement of the adhesion strength of the photographic layer comprising a hydrophilic protective colloid (e.g. gelatin) which is subsequently applied.

The subbing composition according to this invention can be incorporated, in addition, with matting agents (silica and starch), antistatics, surface active agents, or fluorescent whitening agents. Application of the subbing composition according to this invention can be done by ordinary coating procedures such as, for example, dipping, doctor coating, and roller coating. The adhesion performance will not be affected by the method of application.

The photographic layer comprising a hydrophilic protective colloid used in this invention can be a silver halide photographic layer, a so-called filter layer containing dyestuffs and the like, or a photographic layer containing nuclei for physical development in the diffusion transfer technique.

The invention is illustrated below with reference to Examples, but the invention is not limited thereto. In the examples, testing of the adhesion was performed in the following way:

Method of test:

During development:

During the development, the coating layers of the test specimen were cut through with a knife in a checkered pattern and rubbed vigorously to inspect peeling of the coating layers.

After drying:

After drying, the coating layers of the test specimen were cut through with a knife in a checkered pattern and an adhesive tape was forcefully pressed against the coating surface. The tape was then suddenly removed to inspect peeling of the coating layers.

Criteria for rating:

A: No peeling noticed.

B: Slight peeling noticed at the corner of the pattern.

C: Peeling noticed in a portion of the pattern area.

D: Peeling noticed all over the pattern area.

EXAMPLE 1

A sheet of polypropylene synthetic paper ("Yupo" made by Oji Yuka Co.) was subjected to corona discharge treatment and applied with each of the subbing compositions shown in Table 1 at an application rate of 1.0 g/m$^2$ in terms of solids by means of a rod bar coater. After drying, the subbing layer was overcoated with a silver iodobromide gelatin emulsion. The specimen thus prepared was tested to compare subbing compositions with one another.

Table 1

| | Sample No. | 1 | 2 | 3 | 4 | 5 |
|---|---|---|---|---|---|---|
| Corona discharge treatment of polypropylene base | | Yes | No | Yes | Yes | Yes |
| Subbing composition (g) | Lytron-1259 (50%) | 5 | 5 | — | 5 | 5 |
| | Compound No. 2 methanol solution (20%) | 2 | 2 | 2 | — | 2 |
| | Aqueous PVA solution (10%) | 5 | 5 | 5 | 5 | — |
| | Water to make up to | 50 | 50 | 50 | 50 | 50 |
| Adhesion test | Dry | A | C | C | D | B |
| | Wet | A | D | C | C | C |
| Remark | | This invention | | Not this invention | | |

As is apparent from the results shown in Table 1, when subbing compositions which are not within the scope of this invention (Nos. 3, 4 and 5) are used or when the subbing composition of this invention is used without prior corona discharge treatment of the polypropylene base (No. 2), adhesion was unsatisfactory in both dry and wet states. To the contrary, when the subbing composition of this invention was used together with the corona discharge treatment (No. 1), both dry and wet adhesion strengths were satisfactory.

EXAMPLE 2

A resin-coated paper prepared by overlaying a paper base with a film, 25 μthick, made of polypropylene (Noblen-25B made by Mitsubishi Yuka Co.) blended with 10% of titanium oxide was used. The resin-coated paper was coated with each subbing composition shown in Table 2 to examine the effects of corona discharge treatment and the type of hardener on the adhesion. The dry and wet adhesion strengths were tested after the subbing layer had been dried and a silver iodobromide emulsion coated thereon.

Table 2

| | Sample No. | 6 | 7 | 8 | 9 | 10 | 11 | 12 | 13 |
|---|---|---|---|---|---|---|---|---|---|
| Subbing composition (g) | Lytron 2128* (50%) | 5 | 5 | — | 5 | — | — | — | — |
| | DPP-722* (50%) | — | — | 5 | — | 5 | — | — | — |
| | Colloidal silica | — | — | — | — | — | 5 | — | — |
| | Alumina | — | — | — | — | — | — | 5 | — |
| | Clay | — | — | — | — | — | — | — | 5 |
| | (b) Compound No. 6 in methanol (20% solution) | 2 | — | — | — | — | — | — | — |
| | (b) Compound No. 2 in methanol (20% solution) | — | 2 | 2 | 2 | 2 | 2 | 2 | 2 |
| | (c) PVA (10% aqueous solution) | 5 | 5 | 5 | — | — | 5 | 5 | — |
| | (c) CMC (10% aqueous solution) | — | — | — | 5 | 5 | — | — | 5 |
| | Water to make up to | 50 | 50 | 50 | 50 | 50 | 50 | 50 | 50 |
| Adhesion strength | Dry | A | A | A | A | A | C | C | C |
| | Wet | A | A | A | A | A | D | C | D |

Note:

*Lytron 2128: A plastic pigment of Monsanto Chemical Co. (Fine dispersion of polystyrene, 0.2 mμ).

*DPP-722: A plastic pigment of Dow Chemical Co. (Fine dispersion of polystyrene, 0.5 mμ).

As is seen from Table 2, subbing compositions (sample Nos. 11 to 13) containing inorganic pigments in place of plastic pigments used in the subbing compositions of this invention (sample Nos. 6 to 10) failed in exhibiting sufficient adhesion strength in both dry and wet conditions. It was also found that the type and particle size of a plastic pigment do not cause any particular difference in adhesion strength and, hence, any emulsion containing a styrene polymer as major component can be used with satisfactory results. As for the component (c), any water-soluble polymer such as PVA derivatives or a copolymer can be used.

EXAMPLE 3

A sheet of polypropylene synthetic paper ("Yupo" made by Oji Yuka Co.) was subjected to corona discharge treatment and applied with each subbing composition shown in Table 3 at coating weight of 1.0 g/m$^2$ in terms of solids by means of a rod bar coater. After drying, the subbing layer was overcoated with a silver iodobromide gelatin emulsion. The specimen thus prepared was tested to compare subbing compositions with one another.

Table 3

| Sample No. | Finely divided polymeric substance (5 g as solids) | Compound No. (0.8 g) | Water-soluble polymer (1 g) | Adhesion strength Dry | Adhesion strength Wet | Remark |
|---|---|---|---|---|---|---|
| 14 | DPP-722 (polystyrene) | 1 | Phthalated gelatin | A | A | |
| 15 | Lytron-2128 (polystyrene) | 25 | " | A | A | |
| 16 | Polyvinyl chloride | 1 | " | A | A | This invention |
| 187 | " | 25 | " | A | A | |
| 18 | Butadiene-methyl methacrylate copolymer | 1 | " | A | A | |
| 19 | Butadiene-methyl methacrylate | 25 | " | A | A | |

Table 3-continued

| Sample No. | Finely divided polymeric substance (5 g as solids) | Compound No. (0.8 g) | Water-soluble polymer (1 g) | Adhesion strength Dry | Adhesion strength Wet | Remark |
|---|---|---|---|---|---|---|
| | copolymer | | | | | |
| 20 | Butadiene-n-butyl methacrylate copolymer | 1 | " | A | A | |
| 21 | Butadiene-n-butyl methacrylate copolymer | 25 | " | A | A | |
| 22 | Butadiene-acrylonitrile copolymer | 1 | " | C | D | |
| 23 | Butadiene-acrylonitrile copolymer | 25 | " | C | D | |
| 24 | Polyethylene | 1 | " | D | D | |
| 25 | " | 25 | " | D | D | Not |
| 26 | Butadiene-styrene copolymer | 1 | " | C | C | this |
| 27 | " | 25 | " | C | C | in- |
| 28 | Polyvinylidene-chloride | 1 | " | D | C | ven- |
| 29 | " | 25 | " | D | C | tion |
| 30 | Vinyl acetate-acrylonitrile copolymer | 1 | " | C | B | |
| 31 | Vinyl acetate-acrylonitrile copolymer | 25 | " | C | B | |
| 32 | Vinyl acetate-ethylene copolymer | 1 | " | C | D | |
| 33 | Vinyl acetate-ethylene copolymer | 25 | " | C | D | |

As is seen from Table 3, markedly inferior adhesion was obtained with the samples (No, 22 to No. 33) wherein fine polymer latex not specified in this specification were used in combination with the compound No. 1 or No. 25 and a water-soluble polymer.

What is claimed is:

1. A photographic material comprising a support having on the surface a polypropylene resin component treated with corona discharge, a subbing layer which is applied to said polypropylene resin surface and comprises (a) at least one water-dispersed polymer latex selected from butadiene-acrylic ester copolymers, polyvinyl chloride homopolymer and polystyrene homopolymer, (b) a compound having at least two ethyteneimino groups in the molecule and (c) a water-soluble polymer compatible with said water-dispersed polymer latex, and at least one hydrophilic protective colloid layer including a silver halide emulsion layer provided on said subbing layer.

2. A photographic material according to claim 1, wherein the compound having an ethyleneimino group is at least one compound selected from the group consisting of polyethyleneimine and the compounds having the following structural formulas:

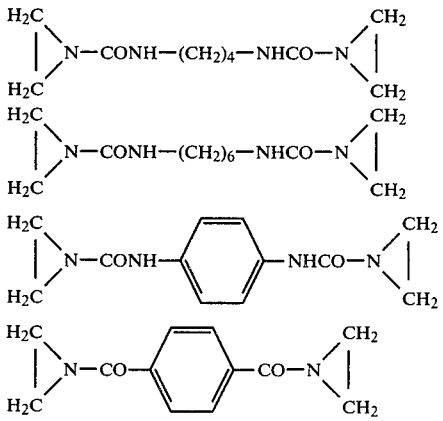

-continued

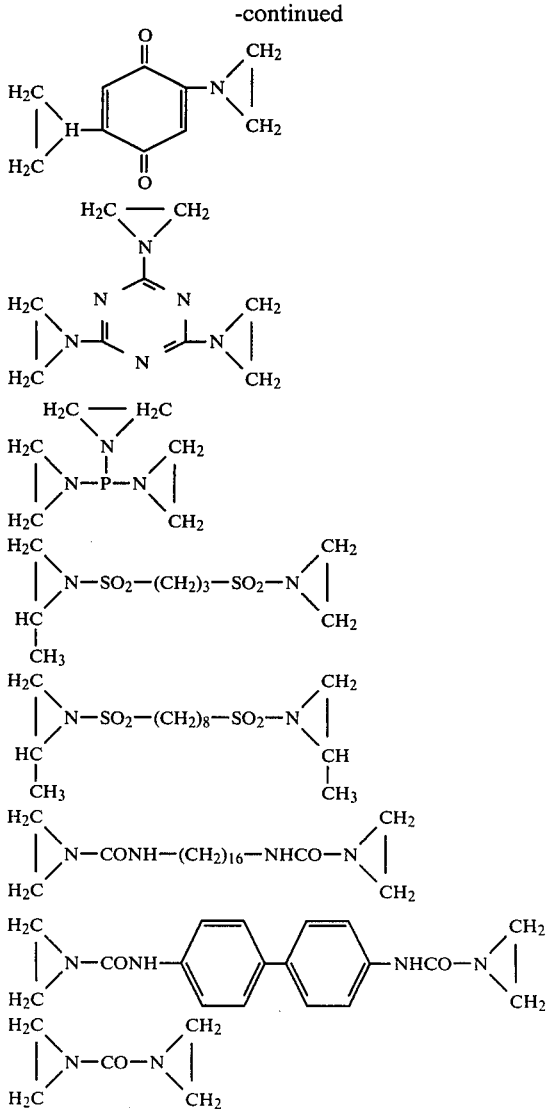

-continued

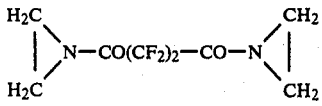

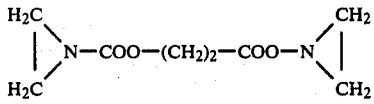

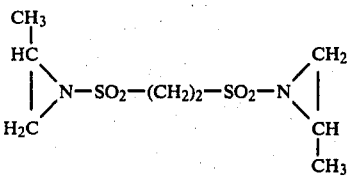

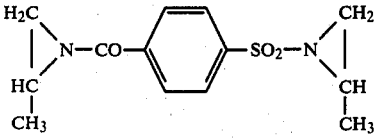

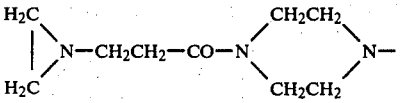

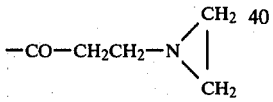

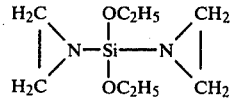

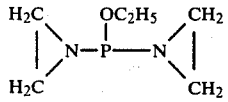

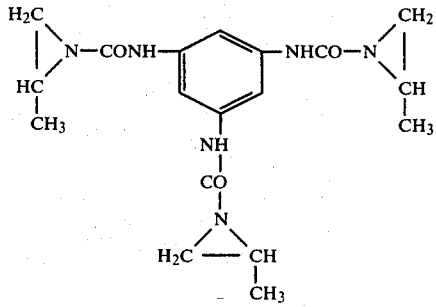

-continued

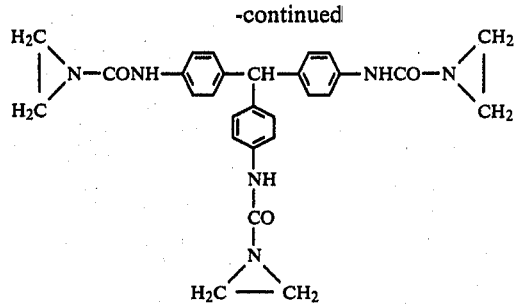

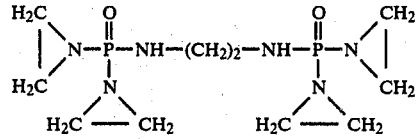

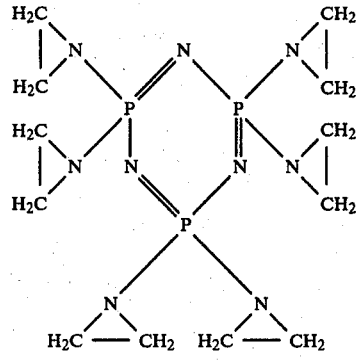

, and

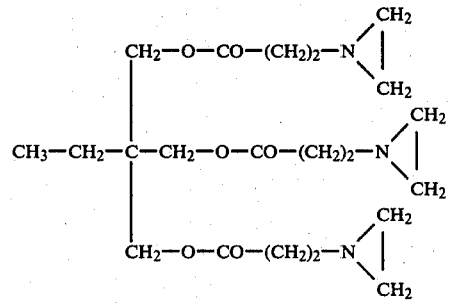

3. A photographic material according to claim 1, wherein the water-soluble polymer is at least one component selected from the group consisting of casein, gelatin, grafted gelatin, carboxymethylcellulose, hydroxyethylcellulose , starch, dextrin, vegetable gums, polyvinyl alcohol, polyacrylamide, polyvinylpyrrolidone, styrene-maleic acid copolymer, and ethylene-maleic acid copolymer.

4. A photographic material according to claim 1, wherein the subbing layer contains, 0.1 to 20% of the water-dispersed polymer latex, 0.05 to 10% of the compound having an ethyleneimino group, and 0.05 to 10% of the water-soluble polymer.

5. A photographic material according to claim 1, wherein the coating weight of the subbing layer is 0.01 to 20 g/m$^2$ in terms of solids.

6. A photographic material according to claim 1, wherein the support having on the surface a polypropylene resin component is polypropylene synthetic paper.

7. A photographic material according to claim 1, wherein the support having on the surface a polypropylene resin component is paper overlaid with a thin film of polypropylene.

* * * * *